US009679683B2

(12) United States Patent
Su et al.

(10) Patent No.: US 9,679,683 B2
(45) Date of Patent: Jun. 13, 2017

(54) OVER-CURRENT PROTECTION DEVICE AND PROTECTIVE CIRCUIT MODULE CONTAINING THE SAME

(71) Applicant: Polytronics Technology Corp., Hsinchu (TW)

(72) Inventors: Tsungmin Su, Hsinchu (TW); Pao Hsuan Chen, Taoyuan (TW); Chao Wei Fang, Hsinchu County (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 72 days.

(21) Appl. No.: 14/950,434

(22) Filed: Nov. 24, 2015

(65) Prior Publication Data

US 2016/0163429 A1 Jun. 9, 2016

(30) Foreign Application Priority Data

Dec. 5, 2014 (TW) ..... 103221593 U

(51) Int. Cl.

| | |
|---|---|
| ***H01C 7/10*** | (2006.01) |
| ***H01C 1/14*** | (2006.01) |
| ***H01C 1/144*** | (2006.01) |
| ***H01C 7/02*** | (2006.01) |

(52) U.S. Cl.
CPC ..... *H01C 1/1406* (2013.01); *H01C 1/144* (2013.01); *H01C 7/02* (2013.01)

(58) Field of Classification Search
CPC ..... H01C 7/008; H01C 7/02; H01C 7/021; H01C 1/14; H01C 1/144
USPC ..... 338/22 R, 13
See application file for complete search history.

(56) References Cited

U.S. PATENT DOCUMENTS

| | | | | |
|---|---|---|---|---|
| 4,414,530 | A * | 11/1983 | Bouffard | H01C 1/1406 338/22 R |
| 5,990,779 | A * | 11/1999 | Katsuki | H01C 1/1406 174/549 |
| 6,104,587 | A * | 8/2000 | Banich | H01C 1/1406 338/22 R |
| 6,489,880 | B2 * | 12/2002 | Miyazaki | H01C 1/01 338/22 R |
| 6,690,258 | B2 * | 2/2004 | Katsuki | H01C 1/1406 338/22 R |
| 6,713,210 | B1 | 3/2004 | Sato et al. | |
| 7,203,049 | B2 * | 4/2007 | Chu | H01C 7/02 338/203 |

(Continued)

*Primary Examiner* — Kyung Lee
(74) *Attorney, Agent, or Firm* — Muncy, Geissler, Olds & Lowe, P.C.

(57) ABSTRACT

An over-current protection device comprises a PTC device and a first external lead. The PTC device comprises first and second conductive layers and a PTC material layer laminated therebetween. The first conductive layer forms an upper surface of the PTC device. The first external lead has a lower surface soldered to the first conductive layer. The lower surface is provided with a plurality of protrusions of which tops are in direct contact with the first conductive layer to form a gap between the first external lead and the first conductive layer. Solder paste fills the gap to form an electrically conductive connecting layer. The over-current protection device may further comprise a second external lead with protrusions soldered to the second conductive layer to form an axial-lead or a radial-lead type device.

13 Claims, 4 Drawing Sheets

(56) References Cited

U.S. PATENT DOCUMENTS

| | | | | |
|---|---|---|---|---|
| 7,852,192 | B2 | 12/2010 | Yu et al. | |
| 2002/0109576 | A1* | 8/2002 | Wang | H01C 17/06586 338/22 R |
| 2003/0026053 | A1* | 2/2003 | Toth | H01C 1/1406 361/106 |
| 2005/0200447 | A1* | 9/2005 | Chandler | H01C 1/1406 338/25 |
| 2007/0057759 | A1* | 3/2007 | Koyama | H01C 1/1406 338/22 R |
| 2014/0049357 | A1* | 2/2014 | Tseng | H01C 7/02 338/22 R |

* cited by examiner

OVER-CURRENT PROTECTION DEVICE AND PROTECTIVE CIRCUIT MODULE CONTAINING THE SAME

BACKGROUND OF THE INVENTION (1) Field of the Invention

The present application relates to an over-current protection device and a protective circuit module (PCM) containing the same, more specifically, to an over-current protection device with high bonding strength to combine with external leads and a protective circuit module containing the same.

(2) Description of the Related Art

Because the resistance of a conductive composite material having positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at a normal temperature, so that the circuit or cell can operate normally. However, when an over-current or an over-temperature event occurs in the circuit or cell, the crystalline polymer of the PTC conductive composite material will melt and expand to sever a lot of conductive paths and therefore the resistance instantaneously increases to a high resistance state (i.e., trip) to diminish the current.

As shown in FIG. 8, U.S. Pat. No. 6,713,210 discloses a protective circuit module with over-current protection function. An IC device 2 is disposed on a protective circuit module 1, and a PTC device 3 is surface-mounted onto a surface of the protective circuit module 1. The PTC device 3 is a laminated structure, in which a PTC material layer 6 is sandwiched between nickel foils or nickel-plated copper foils 7 and 7'. The nickel foils 7 and 7' serve as electrodes of the PTC material layer 6. A nickel plate 4 serving as an external electrode is secured on the upper surface of the nickel foil 7, and a copper electrode 5 is soldered to the lower surface of the nickel foil 7' that is adjacent to the surface of the protective circuit module 1. The nickel plate 4 and the copper plate 5 are symmetrical with reference to the PTC device 3. The nickel plate 4 has an end extending out of the PTC device 3 so as to connect to an apparatus such as a battery. When connecting to a battery, the nickel plate 4 may need to bend to conform to the position or shape of the battery, and therefore stress would generate in the nickel plate 4. If the bonding strength of the nickel plate 4 and the PTC device 3 is insufficient, the nickel plate 4 may peel off the PTC device 3.

Because of high voltage and high current in spot-welding process, the PTC device 3 cannot be subjected to spot-welding directly. U.S. Pat. No. 7,852,192 discloses that an insulating layer and an electrode layer are further added to the surface of the PTC device and conductive blind holes are used to electrically connect to the electrode layer and the nickel foil of the PTC device, thereby the device can be subjected to spot-welding directly.

However, in the aforementioned designs, when the external nickel plate electrode is jointed to the device by reflow, solder paste may be daubed unevenly and the thickness of the solder paste may not be well-controlled. As a result, the bonding strength of the nickel plate is not enough. When the PTC device (chip size) becomes smaller, the amount of the solder paste is hard to be accurately controlled and solder paste is easily overflowed because the gap between the PTC device and the nickel plate is hard to keep consistent. Therefore, the bonding strength of the external lead decreases or changes, resulting in low or unstable production yield.

SUMMARY OF THE INVENTION

To resolve insufficient or unstable bonding strength between the PTC device and the external lead, the surface of external lead adapted to bond with the PTC device is provided with protrusions, so as to increase joint contact area and form a three-dimensional joint structure to improve the bonding strength therebwteeen. In addition to the joint of the external lead of the over-current protection device, the present application can be applied to a protective circuit module in which the external lead of the over-current protection device needs to be bent.

In a first aspect of the present application, an over-current protection device comprises a PTC device and a first external lead. The PTC device comprises first and second conductive layers and a PTC material layer. The first conductive layer forms an upper surface of the PTC device, and the PTC material layer is disposed between the first and second conductive layers to form a laminated structure. The first external lead has a lower surface connecting to the first conductive layer by solder paste, and the lower surface comprises a plurality of protrusions of which tops are in direct contact with the first conductive layer. As a consequence, a gap is formed between the first external lead and the first conductive layer, and receives solder paste to form an electrically conductive connecting layer.

In an embodiment, the over-current protection device may further comprise a second external lead adapted to be soldered onto the second conductive layer, so as to form an axial-leaded or radial-leaded over-current protection device. The second external lead has an upper surface connecting to the second conductive layer by solder paste, the upper surface of the second external lead comprising a plurality of protrusions, tops of the protrusions being in contact with the second conductive layer to form a gap between the second external lead and the second conductive layer for being filled with solder paste to form another electrically conductive connecting layer.

In an embodiment, the second conductive layer forms a lower surface of the PTC device to be soldered onto a circuit board.

In an embodiment, the gap has a thickness in the range of 0.01 to 0.16 mm.

In an embodiment, the first and second conductive layers are in direct contact with upper and lower surfaces of the PTC material layer, respectively, and the over-current protection device is in a rectangular or circular shape.

In an embodiment, each of the protrusions has a diameter of 0.1-0.5 mm.

In an embodiment, the protrusions are evenly distributed in an overlap portion of the first external lead and the PTC device.

In an embodiment, the over-current protection device has a third conductive layer, an insulating layer and at least one conductive blind hole. The third conductive layer is in contact with an upper surface of the PTC material layer. The insulating layer is laminated between the first and third conductive layer. The conductive blind hole electrically connects to the first and third conductive layers, and may be filled with solder paste to increase bonding strength.

In an embodiment, tops of the protrusions have openings through which the solder paste fills.

In an embodiment, the first external lead comprises at least one opening not located at the protrusions for filling solder paste therethrough when the PTC device is subjected to pressing process.

In a second aspect of the present application, a protective circuit module comprises a circuit board and an over-current protection device mentioned above. The second conductive layer is soldered onto the circuit board and electrically connects to circuitry of the circuit board.

In an embodiment, the first and second conductive layers are copper foils, nickel foils or nickel-plated copper foils.

The protrusions can increase joint contact surface of solder paste and form a three-dimensional joint structure to effective enhance the bonding strength of the external lead to the PTC device. Accordingly, the stability and the production yield of the over-current protection device or the protective circuit module containing the same can be improved.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
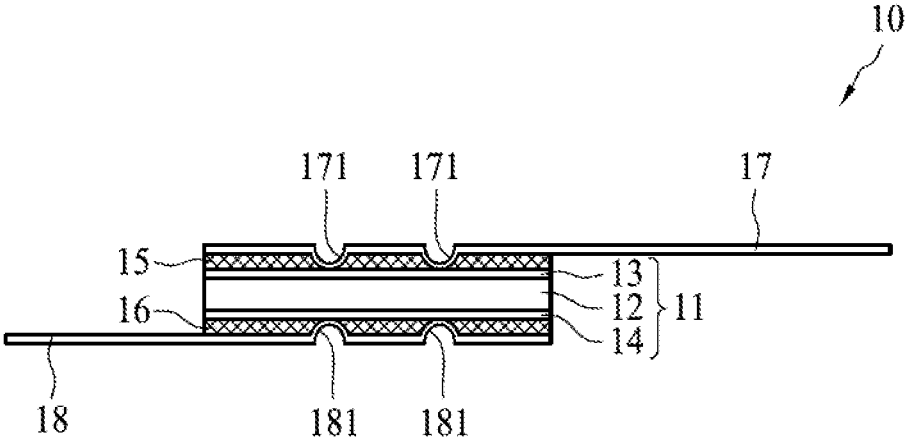
FIG. 1 shows an over-current protection device in accordance with an embodiment of the present application.

FIG. 1 shows an over-current protection device 10 comprising a PTC device 11, electrically conductive connecting layers 15 and 16, a first external lead 17 and a second external lead 18. The first external lead 17, the electrically conductive connecting layer 15, the PTC device 11, the electrically conductive connecting layer 16 and the second external lead 18, from top to bottom, are stacked in sequence to form a laminated structure. The PTC device 11 comprises a first conductive layer 13, a second conductive layer 14 and a PTC material layer 12. The first conductive layer 13 forms an upper surface of the PTC device 11, the second conductive layer 14 forms a lower surface of the PTC device 11, and the PTC material layer 12 is sandwiched between the first and second conductive layers 13 and 14 to form a laminated structure. The first external lead 17 has a lower surface connecting to the first conductive layer 13 through solder paste. The lower surface of the first external lead 17 is provided with protrusions 171, and tops of the protrusions 171 are in direct contact with the first conductive layer 13, so as to form a gap between the first conductive layer 13 and the first external lead 17 for being filled with solder paste to form an electrically conductive connecting layer 15. Likewise, the upper surface of the second external lead 18 is provided with protrusions 181, and tops of the protrusions 181 are in direct contact with the second conductive layer 14 through solder paste, so as to form a gap between the second conductive layer 14 and the second external lead 18 for being filled with solder paste to form an electrically conductive connecting layer 16. The first external lead 17 and the second external lead 18 extend in opposite directions to form an axial-leaded over-current protection device 10. In addition to the three-layer structure shown in FIG. 1, the PTC device 11 may be of other structure according to the need of soldering.

Figure 2:
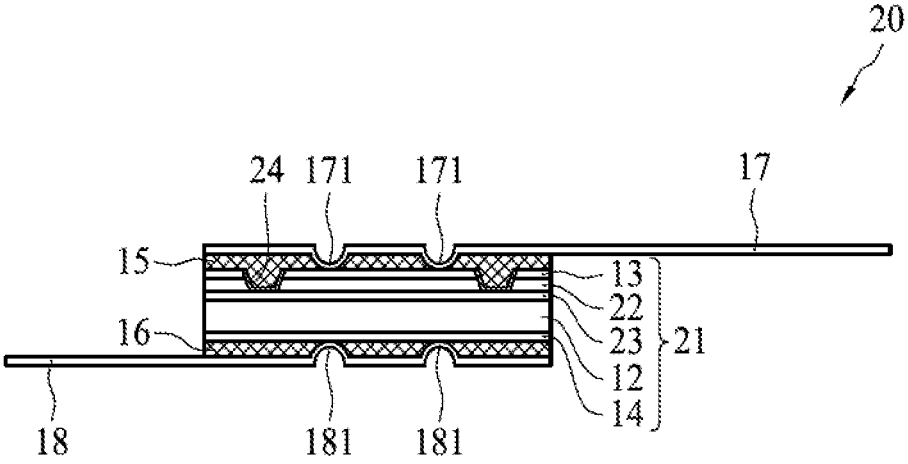
FIG. 2 shows an over-current protection device in accordance with another embodiment of the present application.

FIG. 2 shows an over-current protection device in accordance with another embodiment of the present application. An over-current protection device 20 comprises a PTC device 21, electrically conductive connecting layers 15 and 16, a first external lead 17 and a second external lead 18. The PTC device 21 is different from the PTC device 11 shown in FIG. 1 in detail. The PTC device 21 is a laminated structure comprising, from top to bottom, a first conductive layer 13, an insulating layer 22, a third conductive layer 23, a PTC material layer 12 and a second conductive layer 14. Conductive blind holes 24 are formed between the first conductive layer 13 and the third conductive layer 23 for electrical conduction. For example, blind holes may be formed first by laser-drilling, and conductive films are formed on the walls of the blind holes by electroplating to form the conductive blind holes 24. The conductive films may not fully fill the blind holes 24, and thus voids remain therein. When soldering the first external lead 17 onto the PTC device 21, the solder paste of the electrically conductive connecting layer 15 fills the conductive blind holes 24 (voids) to increase joint contact area of the electrically conductive connecting layer 15 and therefore improve bonding strength. The insulating layer 22 of the PTC device 21 can withstand high current and high voltage in sequential spot-welding to avoid damage.

Figure 3:
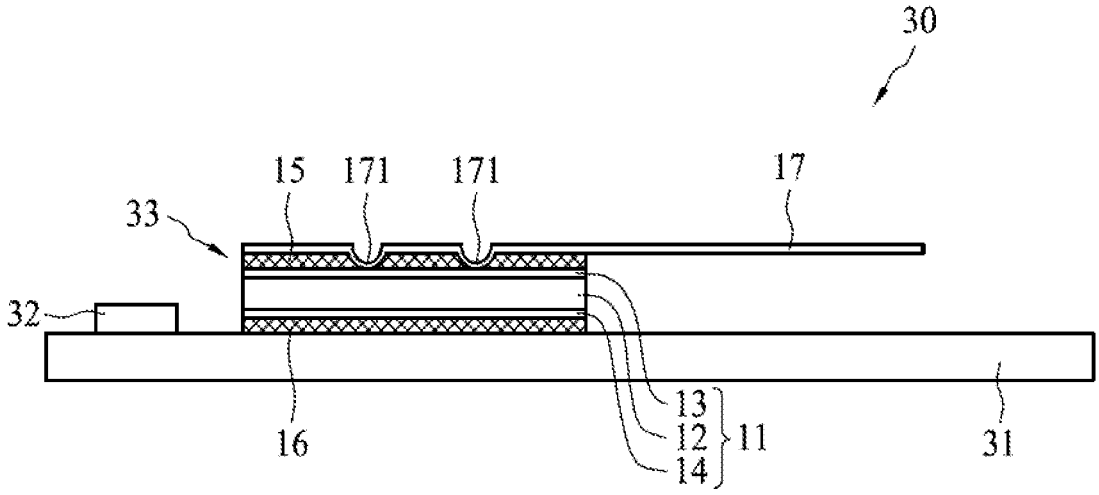
FIG. 3 shows a protective circuit module in accordance with an embodiment of the present application.

FIG. 3 shows a protective circuit module 30 in accordance with a first embodiment of the present application. The protective circuit module 30 comprises a circuit board 31, an IC device 32 and an over-current protection device 33. The IC device 32 and the over-current protection device 33 are disposed on and electrical coupled to the circuit board 31. The over-current protection device 33 is similar to the the over-current protection device 10 in FIG. 1 except that the second conductive layer 14 is soldered onto the circuit board 31 instead of the second external lead 18. Likewise, the first external lead 17 comprises protrusions 171 at the bottom surface, and tops of the protrusions 171 are in direct contact with the first conductive layer 13. Accordingly, a gap is formed between the first external lead 17 and the first conductive layer 13, and is filled with solder paste to form an electrically conductive connecting layer 15 when soldering the first external lead 17 onto the PTC device 11. The protective circuit module 30 can be applied to, for example, batteries of mobile apparatuses for over-current protection. The first external lead 17 may need to be bent to connect to a battery, and thus stress would be generated in the first external lead 17. With increment of solder paste contact area and formation of a three-dimensional joint structure, the protrusions 171 improve the bonding strength between the first external lead 17 and the PTC device 11, so as to prevent the first external lead 17 from peeling off the PTC device 11.

Figure 4:
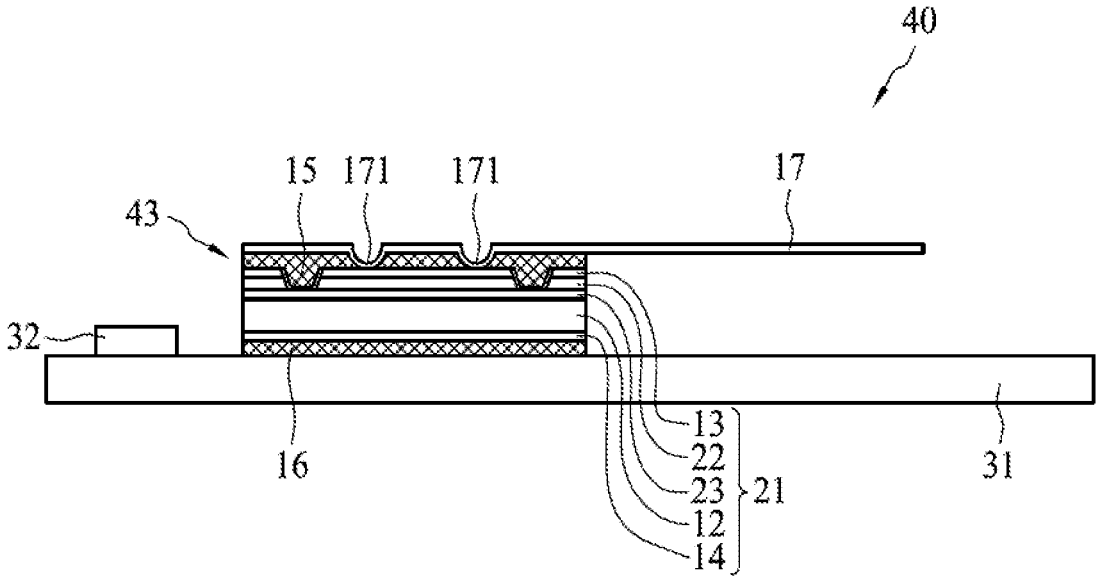
FIG. 4 shows a protective circuit module in accordance with another embodiment of the present application.

FIG. 4 shows a protective circuit module 40 in accordance with a second embodiment of the present application. The protective circuit module 40 comprises a circuit board 31, an IC device 32, and an over-current protection device 43. The IC device 32 and the over-current protection device 43 are disposed on the circuit board 31. The over-current protection device 43 is similar to the over-current protection device 20 except that the second conductive layer 14 is soldered onto the circuit board 31 instead of the second external lead 18. Likewise, the first external lead 17 comprises protrusions 171 on the bottom surface. With the increment of solder paste contact area and formation of a three-dimensional joint structure, the protrusions 171 can improve the bonding strength between the first external lead 17 and the PTC device 21, so as to prevent the first external lead 17 peeling from the PTC device 21. The solder paste forming the electrically conductive connecting layer 15 fills the conductive blind holes 24 to increase joint contact area and bonding strength. The insulating layer 22 of the PTC device 21 can withstand high current and high voltage in sequential spot-welding process to avoid damage.

Figure 5:
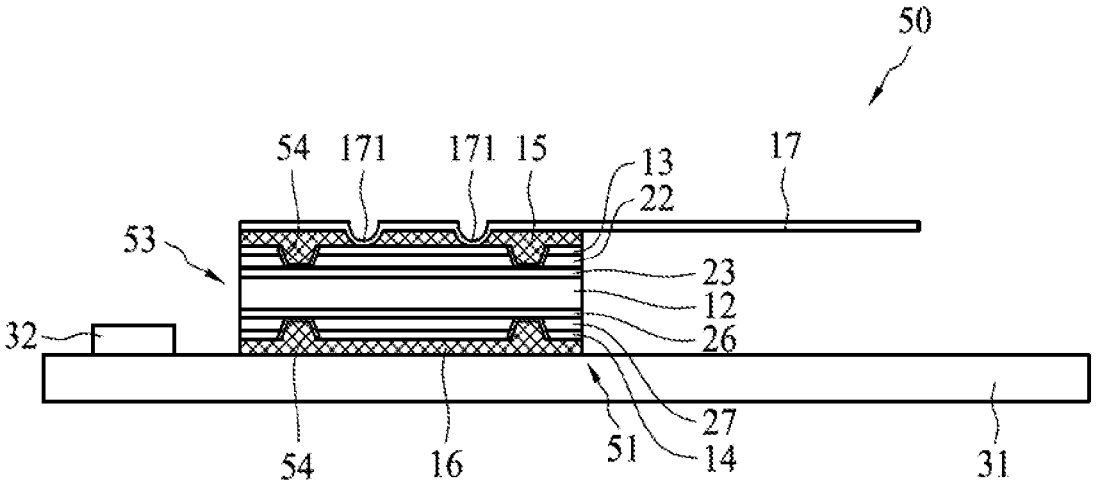
FIG. 5 shows a protective circuit module in accordance with yet another embodiment of the present application.

FIG. 5 shows a protective circuit module 50 in accordance with a third embodiment of the present application. The protective circuit module 50 comprises a circuit board 31, an IC device 32, and an over-current protection device 53. The IC device 32 and the over-current protection device 53 are disposed on and electrical coupled to the circuit board 31. The over-current protection device 53 comprises a PTC device 51 and a first external lead 17. The PTC device 51 is a laminated structure comprising, from top to bottom, a first conductive layer 13, an insulting layer 22, a third conductive layer 23, a PTC material layer 12, a fourth conductive layer 26, an insulating layer 27 and a second conductive layer 14. In particular, the PTC device 51 is a symmetrical structure, and therefore it is non-orientation design to prevent erroneous turnover placement. Likewise, conductive holes 54 are formed between the first conductive layer 13 and the third conductive layer 23, and between the second conductive layer 14 and the fourth conductive layer 26 for electrical connection. The first external lead 17 is soldered onto the first conductive layer 13 of the PTC device 51, and the second conductive layer 14 is soldered onto the circuit board 31. The first external lead 17 comprises protrusions 171 on its bottom surface, and tops of the protrusions 171 are in direct contact with the first conductive layer 13. Accordingly, a gap is formed between the first external lead 17 and the first conductive layer 13. The gap is filled with solder paste to form an electrically conductive connecting layer 15 when soldering the first external lead 17. When soldering the second conductive layer 14 onto the circuit board 31, solder paste forms the second electrically conductive connecting layer 16 between the second conductive layer 14 and circuit board 31.

In an embodiment, the aforesaid gap forming the electrically conductive connecting layer 15 or 16 has a thickness of approximately 0.01-0.16 mm, e.g., 0.04 mm, 0.07 mm, 0.1 mm, or 0.13 mm.

In an embodiment, the first and second conductive layers 15 and 16 are in direct contact with upper and lower surfaces of the PTC material layer 12, respectively, and are in a rectangular or circular shape.

Referring to FIG. 1 again, the tensile test data of the first external lead 17 with protrusions 171 and without protrusions are listed in Table 1 below to assess the influence of the protrusions 171 to bonding strength. There are four set of samples, the size of the over-current protection device 11 is 2.3 mm×2.3 mm, and the first external lead 17 has a length of 7.5 mm and a width of 2.3 mm. In the tensile test, a force applied to the first external lead 17 increases gradually, and the force (unit: kgf) is recorded when the first external lead 17 peels off the PTC device 11. It can be seen from Table 1 that the samples with protrusions have higher tensile strength than those without protrusions by 30-70%. In other words, the first external lead 171 with protrusions can increase bonding strength by approximately 30-70%.

TABLE 1

| Sample set | Tensile strength (kgf) Sample with protrusions | Tensile strength (kgf) Sample without protrusions |
|---|---|---|
| 1 | 1.2 | 0.82 |
| 2 | 1.01 | 0.6 |
| 3 | 1.32 | 0.9 |
| 4 | 1.15 | 0.88 |

Figure 6:
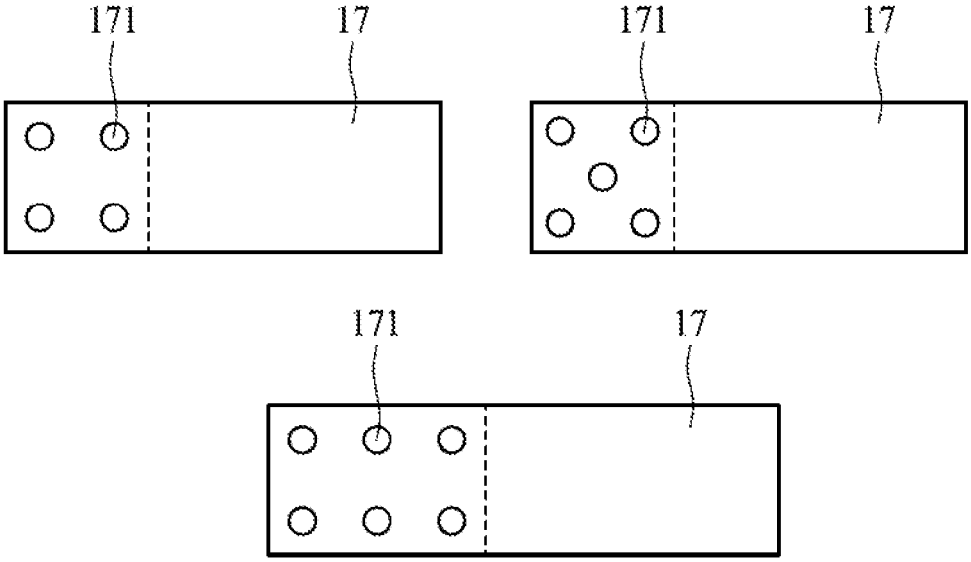
FIG. 6 shows a top view of an external lead of the over-current protection device in accordance with an embodiment of the present application.

FIG. 6 shows an exemplary top view of the first external lead 17. If the overlap of the first external lead 17 and the PTC device 11 or 21 is of an approximately square shape, four or five protrusions 171 may be evenly distributed in the overlap portion (defined by a dashed line in FIG. 6). If the overlap of the first external lead 17 and the PTC device 11 or 21 is of an approximately rectangular shape, six protrusions 171 may be evenly distributed in the rectangular overlap area. In other words, the protrusions 171 are preferably evenly distributed in the overlap area of the first external lead 17 and the PTC device 11 or 21, so as to constitute a constant thickness gap therebetween. Accordingly, solder paste can evenly fills in the gap to form a conductive layer of a constant thickness.

Figure 7:
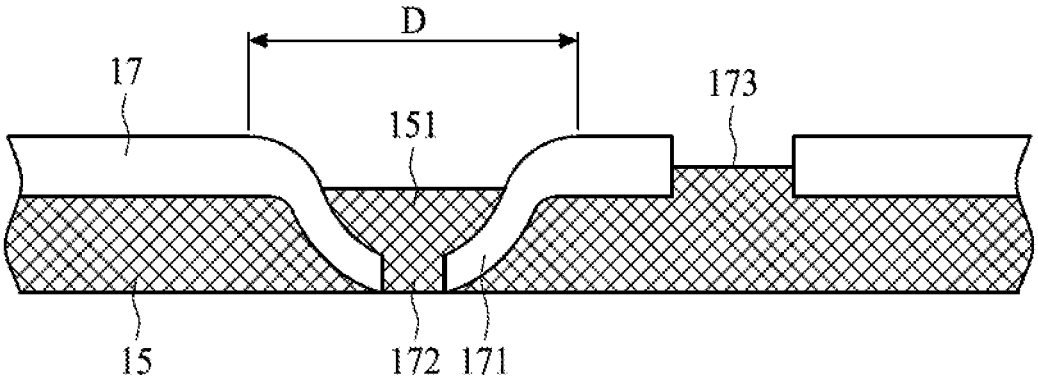
FIG. 7 shows a side view of a protrusion of an external lead of the over-current protection device in accordance with an embodiment of the present application.
Figure 8:
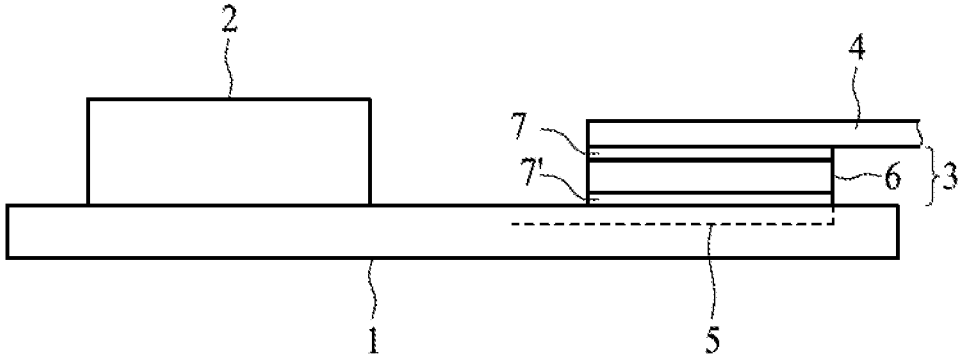
FIG. 8 (Prior Art)
FIG. 8 shows a known protective circuit module.

FIG. 7 shows a side view of a protrusion 171 in accordance with an embodiment of the present application. In addition to traditional punching to form the protrusion 171, the top of the protrusion 171 may have an opening 172 made by laser-drilling. Accordingly, solder paste can fill a cavity formed by the protrusion 171 through the opening 172 to form a solder block 151 in the cavity, thereby further increasing bonding strength of the first external lead 17 and the PTC device. If it is difficult to precisely make the opening 172 at the top of the protrusion 171, an opening 173 may be formed at a place other than the protrusion 171 for filling solder paste to increase bonding strength. In an embodiment, the diameter "D" of the protrusion 171 is approximately 0.1-0.5 mm, e.g., 0.3 mm or 0.4 mm.

The external leads with protrusions in the embodiments shown in FIGS. 3-5 can effectively resolve insufficient bond strength problem of a protective circuit module in which the PTC device and the external lead, e.g., nickel plate, are not firmly bonded. For a traditional design, the gap size between the PTC device and the external lead is hard to keep constant, and therefore the amount of solder paste is hard to be well controlled and solder paste would easily overflow out of the gap, especially for a smaller PTC device. In a worst case, the amount of overflow of solder paste cannot be controlled either, resulting in unstable production yield and weak bonding. For the protrusions provided on a surface of the external lead to be soldered, the heights of the protrusions can precisely control thickness of the gap between the PTC device and the external lead, so as to sustain a constant space for receiving solder paste to prevent overflow of solder paste when pressing. Besides, the protrusions increase contact area between the external lead and solder paste and form a three-dimensional structure which provides higher bonding strength than a two-dimensional structure. In accordance with the present application, the gap of the PTC device and the external lead can keep constant to receive a constant amount of solder paste between the PTC device and the external lead to avoid overflow. Moreover, the tensile tests show that the external lead of the present application has higher bonding strength than a traditional one; it indicates the external lead with protrusions can effectively improve bonding strength.

In summary, in addition to enhance the bonding strength of the external lead of a protective circuit module, the design of the present application also improves the bonding strength of the external leads of the over-current protection device as shown in FIG. 1 or FIG. 2.

The above-described embodiments of the present invention are intended to be illustrative only. Numerous alternative embodiments may be devised by persons skilled in the art without departing from the scope of the following claims.

What is claimed is:

1. An over-current protection device, comprising:

a PTC device comprising first and second conductive layers and a PTC material layer, the first conductive layer forming an upper surface of the PTC device, the PTC material layer being disposed between the first and second conductive layers to form a laminated structure; and a first external lead having a lower surface connecting to the first conductive layer by solder paste, the first external lead comprising a plurality of protrusions on the lower surface, tops of the protrusions being in direct contact with the first conductive layer to form a gap between the first external lead and the first conductive layer, the gap being filled with solder paste to form an electrically conductive connecting layer.

2. The over-current protection device of claim 1, wherein the second conductive layer forms a lower surface of the PTC device to be soldered onto a circuit board.

3. The over-current protection device of claim 1, wherein the gap has a thickness in the range of 0.01 to 0.16 mm.

4. The over-current protection device of claim 1, wherein the first and second conductive layers are in direct contact with upper and lower surfaces of the PTC material layer, respectively, and the over-current protection device is in a rectangular or circular shape.

5. The over-current protection device of claim 1, further comprising a second external lead of which an upper surface connects to the second conductive layer by solder paste, the upper surface of the second external lead comprising a plurality of protrusions, the protrusions being in direct contact with the second conductive layer to form a gap between the second external lead and the second conductive layer, the gap being filled with solder paste to form another electrically conductive connecting layer.

6. The over-current protection device of claim 1, wherein each of the protrusions has a diameter of 0.1-0.5 mm.

7. The over-current protection device of claim 1, wherein the protrusions are evenly distributed in an overlap portion of the first external lead and the PTC device.

8. The over-current protection device of claim 1, further comprising:

a third conductive layer being in contact with an upper surface of the PTC material layer;

an insulating layer laminated between the first and third conductive layer; and at least one conductive blind hole electrically connecting to the first and third conductive layers.

9. The over-current protection device of claim 8, wherein the conductive blind hole is filled with solder paste.

10. The over-current protection device of claim 1, wherein tops of the protrusions have openings through which the solder paste fills.

11. The over-current protection device of claim 1, wherein the first external lead comprises at least one opening not located at the protrusions for filling solder paste therethrough.

12. A protective circuit module, comprises:

a circuit board; and an over-current protection device of claim 1, wherein the second conductive layer is soldered onto the circuit board and electrically connects to circuitry of the circuit board.

13. The protective circuit module of claim 12, wherein the first and second conductive layers are copper foils, nickel foils or nickel-plated copper foils.

* * * * *